United States Patent [19]

Davis et al.

[11] Patent Number: 4,938,711

[45] Date of Patent: Jul. 3, 1990

[54] STRAIN RELIEF FOR RIBBON CABLE CONNECTORS

[75] Inventors: Wayne S. Davis, Harrisburg; Robert N. Whiteman, Jr., Middletown, both of Pa.

[73] Assignee: AMP Incorporated, Harrisburg, Pa.

[21] Appl. No.: 431,726

[22] Filed: Nov. 1, 1989

Related U.S. Application Data

[63] Continuation of Ser. No. 304,046, Jan. 30, 1989, abandoned.

[51] Int. Cl.[5] ..... H01R 4/24

[52] U.S. Cl. ..... 439/405; 439/417

[58] Field of Search ..... 439/389–426

[56] References Cited

U.S. PATENT DOCUMENTS

| | | | |
|---|---|---|---|
| 3,434,093 | 3/1969 | Wedekind | 339/17 |
| 4,062,616 | 12/1977 | Shaffer | 339/99 |
| 4,068,912 | 1/1978 | Hudson | 339/99 |
| 4,111,512 | 9/1978 | Parmer | 339/105 |
| 4,160,574 | 7/1979 | DeRoss | 339/99 |
| 4,190,952 | 3/1980 | Thomas | 29/629 |
| 4,212,507 | 7/1980 | Bunnell | 339/18 |
| 4,252,397 | 2/1981 | Egenbrode et al. | 439/405 |
| 4,359,257 | 11/1982 | Lopinski et al. | 439/405 |
| 4,410,229 | 10/1983 | Stephenson | 339/98 |
| 4,621,885 | 11/1986 | Szczesny | 339/91 |
| 4,668,039 | 5/1987 | Marzili | 339/97 |
| 4,693,533 | 9/1987 | Szczesny | 439/350 |
| 4,773,876 | 9/1988 | Nakamura et al. | 439/417 |

*Primary Examiner*—Joseph H. McGlynn
*Attorney, Agent, or Firm*—David L. Smith

[57] ABSTRACT

An electrical connector (10) for terminating a multi-conductor cable (100) has a housing (12) including a cable terminating face (18), an opposed mating face (16) and opposed end walls (24,26) having latch means (58,60) thereon. The cable terminating face (18) has major edges and minor edges, with the minor edges contiguous with the end walls (24,26). The major edges extend laterally beyond the profile of the mating face (16). The cable terminating face (18) has a rib (44,46) extending along the major edges, upstanding from the cable terminating face (18). A plurality of contacts (30) are secured in the housing (12) and have respective insulation displacement plates (34) extending from the cable terminating face (18). A terminating cover (14) defines an inner surface (80) and major side edges and has latch arms (86, 88) at opposite ends thereof adapted to engage the latch means (58,60) on the connector housing (12) to retain the terminating cover (14) on the housing (12). The terminating cover (14) has an off-set surface (94,96) recessed from the inner surface (80) along the major side edges that cooperates with the rib (44,46) to provide a space through which a ribbon cable (100) terminated to the connector (10) passes and to engage the cable (100) to provide strain relief thereto.

10 Claims, 5 Drawing Sheets

STRAIN RELIEF FOR RIBBON CABLE CONNECTORS

This application is a continuation of application Ser. No. 304,046 filed January 30, 1989, now abandoned.

BACKGROUND OF THE INVENTION

This invention relates to high density connectors for terminating ribbon cable and, in particular, to a ribbon cable terminating connector housing that cooperates with a terminating cover to provide strain relief to a ribbon cable terminated thereto.

U.S. Pat. No. 4,212,507 discloses a strain relief wherein off-set structure on the connector housing and terminating cover provide strain relief to conductors terminated therein. Fluting on the inside cover of such a prior art device would be ineffective to align the conductors of a ribbon cable terminated therein to the insulation displacement contacts as the raised structure along the major edges of the cover would prevent the cable from engaging fluting on the recessed inner surface of the cover until after the insulation displacement termination process has begun. Furthermore, the ribbon cable would be bending at the time insulation displacement termination would be starting.

Prior art ribbon cable connectors for terminating ribbon cable, such as in a daisy chain configuration, are shown in U.S. Pat. Nos. 3,434,093; 4,062,616; 4,068,912; 4,160,574; 4,190,952; 4,410,229; 4,621,885; 4,668,039; and U.S. Pat. No. 4,693,533. These connectors typically provide strain relief such that forces acting on the ribbon cable are not transmitted to and do not stress the insulation displacement electrical connection by clamping the ribbon cable between a flat or fluted surface on the terminating cover and the conductor receiving face from which insulation piercing contacts extend. Typically, the clamping is achieved within the profile of the mating face of the connector so as to minimize the width of the connector.

As ribbon cable conductor centerline spacing is decreased, ribbon cable becomes more fragile and it becomes more desirable to provide strain relief at a location spaced from the insulation displacement terminations. This is particularly important when it is recognized that connectors terminated to a ribbon cable are often unmated from a complementary connector by pulling on the ribbon cable.

It would be desirable to have a ribbon cable terminating connector in which the ribbon cable could be accurately aligned with the conductor receiving slots of insulation piercing terminals prior to termination thereto and be provided with strain relief at a distance spaced from the insulation piercing contacts subsequent to termination.

SUMMARY OF THE INVENTION

In accordance with the invention, an electrical connector for terminating the multi-conductor cable has a housing including a cable terminating face, an opposed mating face and opposed end walls having latch means thereon. The cable terminating face has major edges and minor edges, with the minor edges contiguous with the end walls. The major edges extend beyond the profile of the mating face. The cable terminating face has a rib extending along the major edges, upstanding from the cable terminating face. A plurality of contacts are secured in the housing and have respective conductor receiving portions extending from the cable terminating face. A terminating cover defines an inner surface and major side edges and has latch arms at opposite ends thereof adapted to engage the latch means on the connector housing to retain the cover on the housing. The terminating cover has an off-set recessed from the inner surface along the major side edges that cooperates with the rib to provide a space through which a ribbon cable terminated to the connector passes and to engage the cable to provide strain relief thereto.

DESCRIPTION OF THE PREFERRED EMBODIMENT

Figure 1:
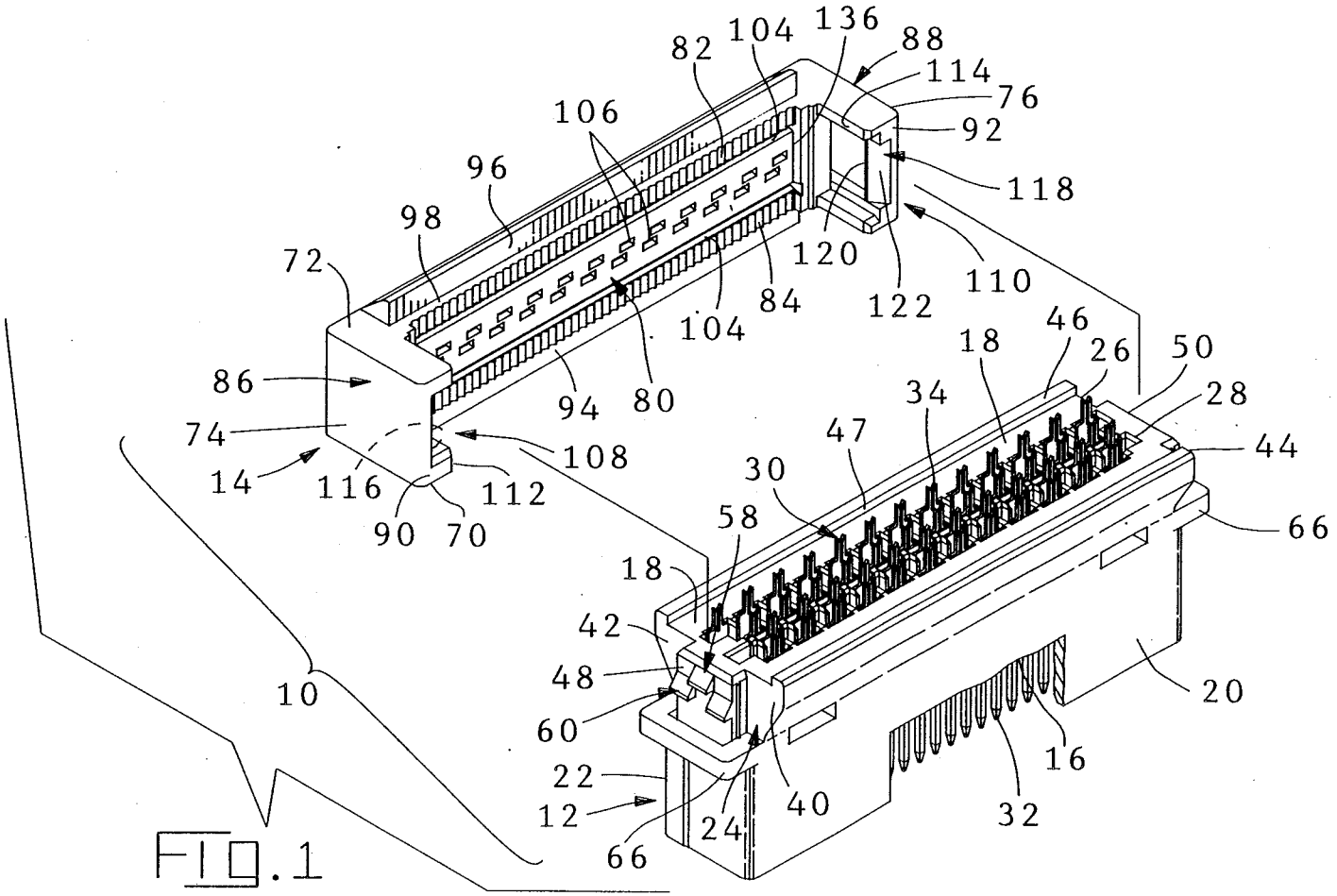
FIG. 1 is a perspective view of a high density ribbon cable connector in accordance with the present invention, with the terminating cover exploded from the connector housing and with the housing partially cut away.

A perspective view of a high density ribbon cable connector 10 in accordance with the present invention is shown in FIG. 1. Connector 10 may take many forms, including being shielded or unshielded or being adaptable for panel mounting Connector 10 includes housing 12 and terminating cover 14. Housing 12 has a forward mating face 16, an opposed conductor receiving face 18, opposing side walls 20,22 and opposing end walls 24,26. Contact receiving passages 28 extend between mating face 16 and conductor receiving face 18, with contacts 30 secured therein.

Figure 3:
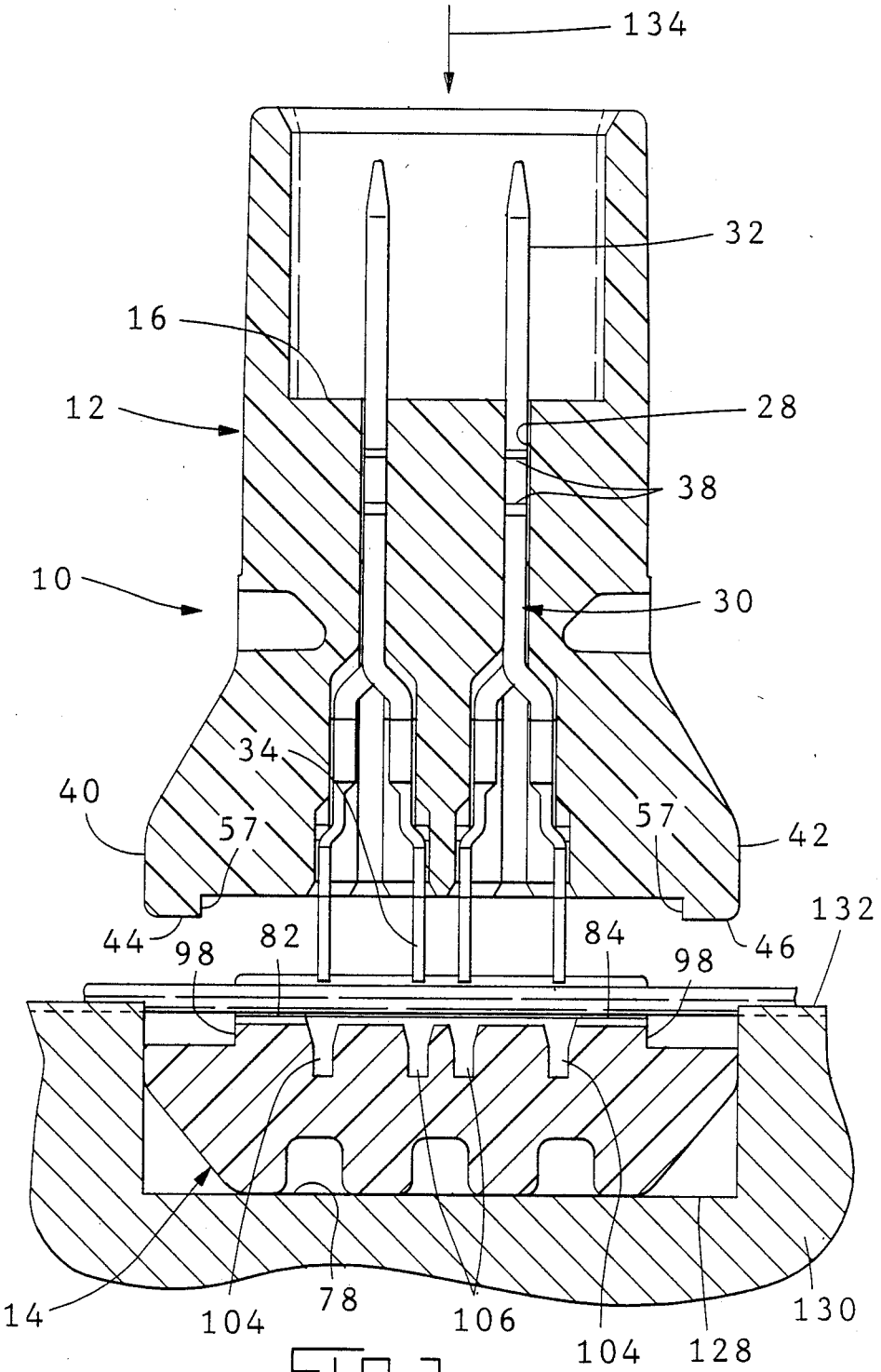
FIG. 3 is an end sectional view of the connector in FIG. 2, taken along the lines 3—3.

Contacts 30 are stamped from strip stock, each contact having a mating portion 32 at one end proximate the mating face, an insulation displacement plate 34 having conductor receiving slot 36 at the other end that extend beyond conductor receiving face 18. Securing means, such as barbs 38 (FIGS. 3 and 5), are provided along contact 30 to secure contacts 30 in respective passages 28, such as by an interference fit.

In the preferred embodiment, contacts 30 are positioned in housing 12, with mating portion 32 in two rows extending substantially between end walls 24 and 26, with centerlines spaced 0.100 inch (2.7 mm) apart; the mating portion of adjacent contacts in each row are spaced 0.050 inch (1.85 mm) apart. The insulation displacement plates 34 form four rows extending substantially between end walls 24 and 26, with the plates 34 positioned to be terminated to conductors of a ribbon cable having a conductor centerline spacing of 0.025 inch (0.925 mm). Each of four adjacent conductors in a ribbon cable are terminated in a respective one of four laterally adjacent insulation displacements plates similar to U.S. Pat. No. 4,668,039 or U.S. Pat. No. 4,693,533, in a staggered relationship, with one of the conductors being terminated in an insulation displacement plate in each of the four rows. The invention, however, is not limited to these contact spacings.

Conductor receiving face 18 has lateral extensions 40,42 that extend laterally beyond the profile of mating face 16 in that side walls 20 and 22 extend outwardly from the axis of the mating portion 32 of contacts 30, as secured in housing 12. Upstanding from conductor receiving face 18 on lateral extensions 40,42 and extending along at least a portion of side walls 20,22 are strain relief ribs 44,46 defining spaced inner edge surfaces 47.

End walls 24,26 have terminating cover alignment ribs 48,50 extending therefrom, respectively. Ribs 48,50 may be chamfered proximate conductor receiving face 18 to facilitate receiving terminating cover 14 thereover. Rib 48 has guide walls 52 and rib 50 has guide walls 54 which parallel insulation displacement plates 34. Guide walls 52 and 54 may be spaced differently to provide a polarization feature such that housing 12 and terminating cover 14 are polarized relative to each other, and the terminating cover can only be received on the housing in a predetermined orientation. Protrusions 56 along guide walls 52,54 provide an interference fit between ribs 48,50 and terminating cover 14, and absorb any tolerance buildup.

Latch means are provided on ribs 48,50 to cooperate with complementary latch means on terminating cover 14 to secure the terminating cover to housing 12. In the preferred embodiment, there are at least two outwardly directed latching protrusions 58,60 displaced along each of ribs 48,50. Each latching protrusion has a tapered surface 62 facing conductor receiving face 18 and a latching shoulder 64 facing mating face 16. Guards 66 extend outwardly from end walls 24,26 to prevent accidental unlatching of terminating cover 14.

Terminating cover 14 is elongate having opposed side walls 70,72, opposed end walls 74,76, outer surface 78 and opposed inner surface 80, a portion of which forms fluted surfaces 82,84 having the same pitch as a cable adapted to be terminated to connector 10. Latch arms 86,88 extend to distal ends 90,92 and are adapted to cooperate with and engage latch means on the housing to secure terminating cover 14 to housing 12. Inner surfaces 80 along side walls 70,72 have surfaces 94,96 recessed from the general plane of the central region of surface 80. Recessed surfaces 94,96 are adapted to be substantially opposed to ribs 44,46 when cover 14 is secured to housing 12 and defines spaced outer edge surfaces 98. Outer edge surfaces 98 are spaced more narrowly than inner edge surfaces 47 on housing 12.

Figure 4:
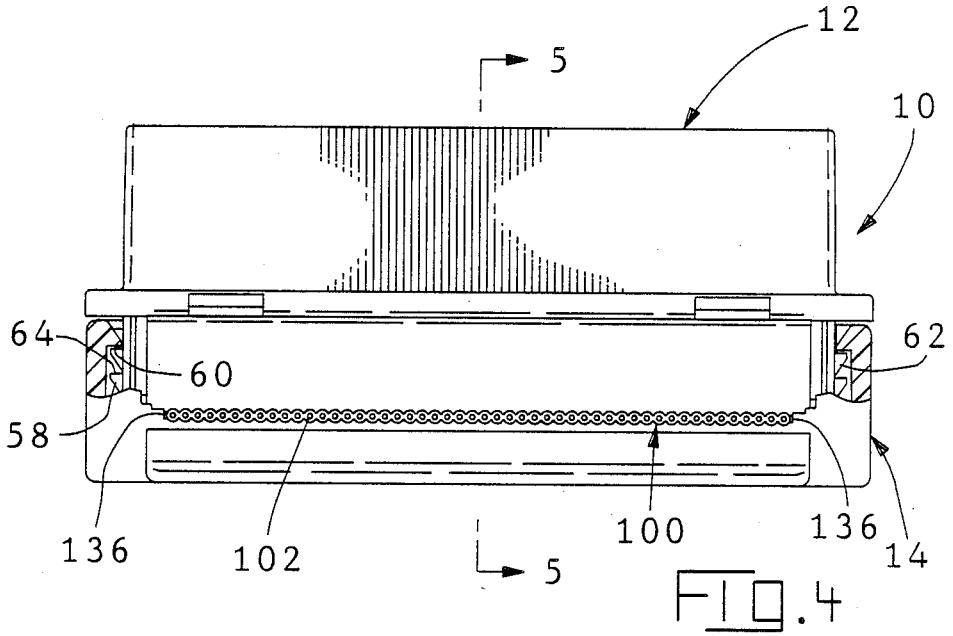
FIG. 4 is a side view, partially sectioned, of the connector of FIG. 1, with a ribbon cable terminated thereto and the termination cover in a terminated position.
Figure 5:
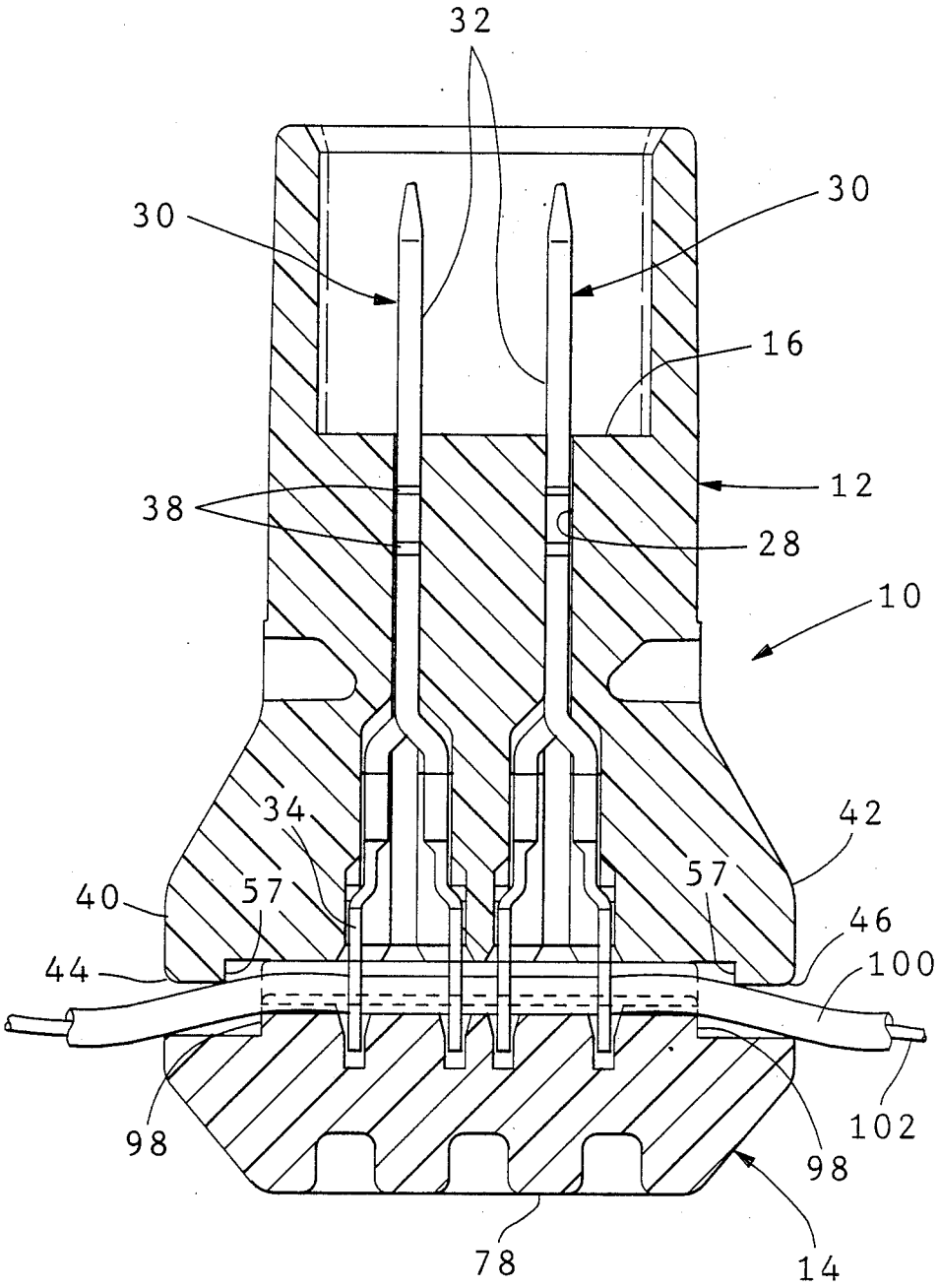
FIG. 5 is an end sectional view of the connector in FIG. 4, taken along the lines 5—5.
Figure 6:
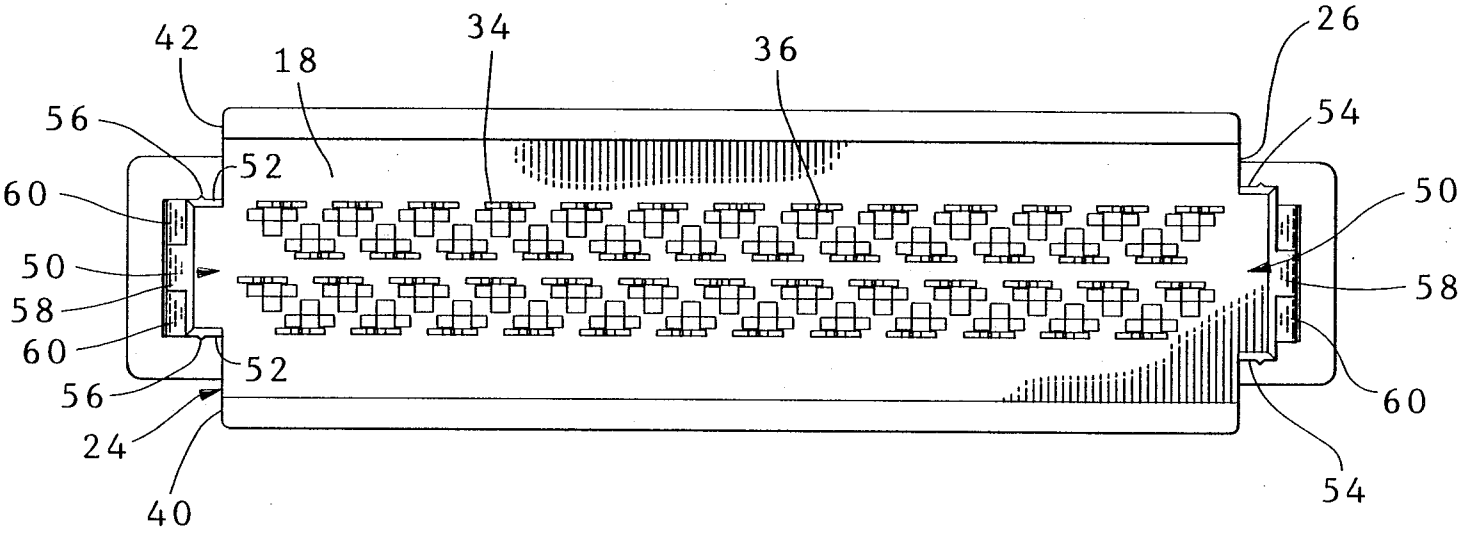
FIG. 6 is a top view of the conductor receiving face of the connector housing.

Strain relief ribs 42,44 on housing 12 cooperate with recessed surface 94,96 on terminating cover 14 to provide strain relief to a ribbon cable 100 having spaced conductors 102, when the conductors 102 of cable 100 are terminated to respective insulation displacement plates 34. The cable 100 covers the ribs, and surface 80 at the offset and the corners dig into the insulation surrounding conductors 102. When terminated, as shown in FIGS. 4 and 5, cable 100 takes a circuitous path and is clamped in the space between ribs 44,46 and recessed surfaces 94,96, as well as spaced inner edge surfaces 47 and spaced outer edge surfaces 98, with the corners digging into the insulation to enhance the strain relief. By making the housing wider in the region of termination, strain relief is provided at a location spaced from the insulation displacement terminations of the individual conductors in respective plates 34.

During termination of ribbon cable 100 onto connector 10, insulation displacement plates 34 pass into recesses 104,106 in inner surface 80. Recesses 104 are continuous for the outer row of plates 34 while recesses 106 are discrete for the inner rows of plates. This provides some plastic adjacent each recess to support the insulation surrounding the conductor being terminated in a plate passing into each recess.

Latch arms 86,88 have a channel 108,110 on an inner wall 112,114 thereof that is complementary to respective terminating cover alignment rib 48, 50. Channels 108,110 may be of differing widths to provide a polarizing feature, as described above. The channels 108,110 cooperate during movement of the termination cover relative to the housing while initially installing the termination cover to a pretermination position, but more critically during termination of a cable 100 to connector 10 as the termination cover moves from a pretermination position to a termination position, to guide the termination cover parallel to the insulation displacement plates of the contacts.

Extending across channels 108,110 near distal ends 90,92 is a cross bar 116, 118. Each cross bar has a latch shoulder 120 facing inner surface 80 and a tapered surface 122 facing the distal end. The tapered surface facilitates cross bars 116,118 riding up over latching protrusions 58,60. Latch shoulders 120 engage latch shoulder 64 protrusion 58 with latch cover 14 in the pretermination position to accurately position latch cover 14 in the pretermination position, tapered surface 122 also engages tapered surface 62 of latch protrusion 60. In the terminated position, latch shoulder 120 engages latch shoulder 64 of latch protrusion 60 to secure terminating covering 14 to housing 12 and maintain cable 100 clamped therebetween to provide strain relief.

Figure 2:
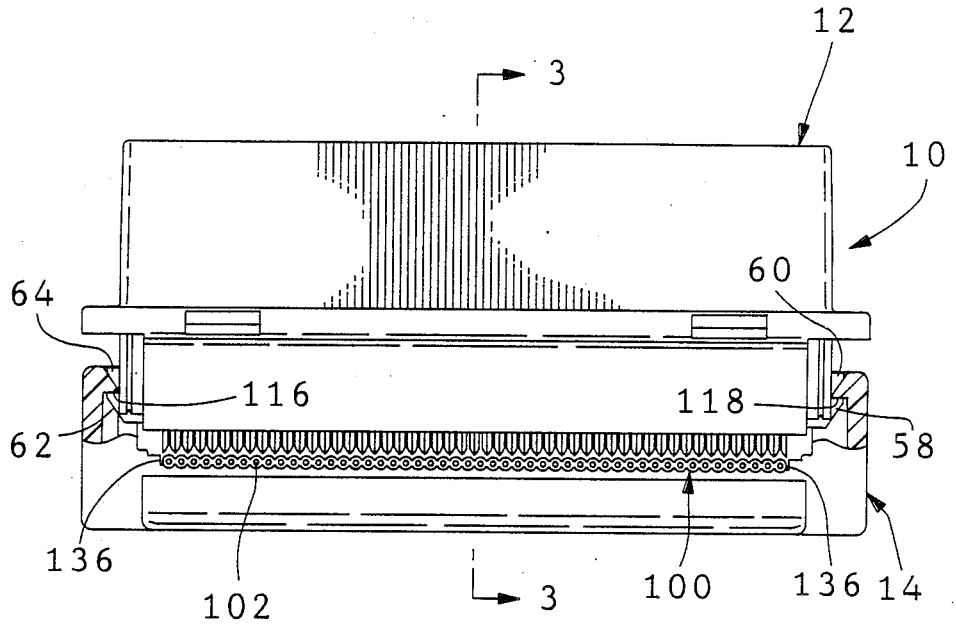
FIG. 2 is a side view, partially sectioned, of the connector of FIG. 1, with a ribbon cable positioned to be terminated and the termination cover in a pretermination position.

Connector 10 is typically supplied with the termination cover secured to the housing in the pretermination position shown in FIG. 2 (without a cable 100). Connector 10 is positioned in recess 128 of the base 130 of a tool, the upper surface 132 of which is substantially coplanar with inside surface 80. Upper surface 132 may be fluted to assist in aligning conductors 102 with slots 36 in plates 34. The edge of cable 100 also extends along edge 136 of inner surface 80 to assist aligning conductors 102 opposite respective slots in insulation displacement plates 34. In this manner, skewing of the cable due to decreased width of the connector is minimized. To position connector 10 on cable 100, cable 100 is slid into and through the space between plates 34 and inside surface 80, with cable 100 engaging fluted surfaces 82,84 to position conductors 102 opposite slots 36 for termination. Cable 102 may be clamped (not shown) against surface 132 to maintain the relative positions so achieved. Housing 12 is moved in the direction of arrow 134, such as by a press (not shown) to cause conductors 102 to terminate to plates 34 in a known manner and to cause terminating cover 14 to move from a pretermination position to a termination position with respect to latch protrusions 58,60. In the terminated position, latch arms retain termination cover 14 in the latched position which retains cable 100 in the circuitous configuration which provides strain relief.

We claim:

1. An electrical connector for terminating multiconductor cable, comprising:

a housing having a cable terminating face, an opposed mating face and opposed end walls having latch means thereon, said cable terminating face having major edges and minor edges, said minor edges contiguous with said end walls, said major edges extending beyond the profile of said mating face, said mating face having a rib extending along each of said major edges, said ribs upstanding from said cable terminating face;

a plurality of contacts in said housing, said contacts having respective conductor receiving portions extending from said cable terminating face;

a terminating cover defining an inner surface, major side edges and having latch arms at opposite ends thereof extending to respective distal ends, said latch arms adapted to engage said latch means to retain said cover on said housing, said terminating cover having an off-set recessed from said inner surface along the major side edges thereof cooperable with the rib to provide a space therebetween for passage of a cable terminated on said connector and to engage said cable to provide strain relief thereto.

2. An electrical connector as recited in claim 1 wherein the interior surface of said terminating cover is fluted.

3. An electrical connector as recited in claim 1 further comprising a rib on each housing end wall parallel to the conductor receiving portions of said contacts and a complementary channel on an inside wall of each latch arm, whereby the ribs and channels cooperate during movement of the termination cover from a pre-termination position to a termination position, such as during termination of a ribbon cable to the connector, to guide the terminating cover parallel to the conductor receiving portions of the contacts.

4. An electrical connector as recited in claim 3 wherein the one rib and its complementary channel are wider than the other rib and channel, whereby the terminating cover and housing are polarized relative to each other in that the terminating cover can only be received on the housing in a predetermined orientation.

5. An electrical connector as recited in claim 1 wherein said terminating cover channels have extending thereacross near the distal end thereof a cross bar having a latch shoulder, each said rib having extending outwardly therefrom at least two spaced latching protrusions cooperable with said cross bar to secure the terminating cover to the housing in first and second latched positions; in the first latched position the inner surface of the terminating cover is spaced from the conductor receiving portions of the contacts to permit insertion and alignment of a cable for termination, the cross bar is positioned between and engaging said at least two latching protrusions, said terminating cover being movable from the first position toward the cable terminating face to terminate a cable, the cable terminating cover securing the cable in a terminated position at the second latched position, with said cross bar engaging one of said at least two spaced latching protrusions.

6. An electrical connector for terminating multiconductor cable, comprising:

a housing having a cable terminating face, an opposed mating face and opposed end walls having latch means thereon, said cable terminating face having major edges and minor edges, said minor edges contiguous with said end walls, at least one of said major edges extending beyond the profile of said mating face, said mating face having a rib extending along said at least one major edge, said rib upstanding from said cable terminating face;

a plurality of contacts in said housing, said contacts having respective conductor receiving portions extending from said cable terminating face;

a terminating cover defining an inner surface, major side edges and having latch arms at opposite ends thereof extending to respective distal ends, said latch arms adapted to engage said latch means to retain said cover on said housing, said terminating cover having an off-set recessed from said inner surface along at least one major side edge thereof, said off-set cooperable with the rib to provide a space therebetween for passage of a cable terminated on said connector and to engage said cable to provide strain relief thereto.

7. An electrical connector as recited in claim 6 wherein the interior surface of said terminating cover is fluted.

8. An electrical connector as recited in claim 6 further comprising a rib on each housing end wall parallel to the conductor receiving portions of said contacts and a complementary channel on an inside wall of each latch arm, whereby the ribs and channels cooperate during movement of the termination cover from a pre-termination position to a termination position, such as during termination of a ribbon cable to the connector, to guide the terminating cover parallel to the conductor receiving portions of the contacts.

9. An electrical connector as recited in claim 8 wherein the one rib and its complementary channel are wider than the other rib and channel, whereby the terminating cover and housing are polarized relative to each other in that the terminating cover can only be received on the housing in a predetermined orientation.

10. An electrical connector as recited in claim 6 wherein said terminating cover channels have extending thereacross near the distal end thereof a cross bar having a latch shoulder, each said rib having extending outwardly therefrom at least two spaced latching protrusions cooperable with said cross bar to secure the terminating cover to the housing in first and second latched positions; in the first latched position the inner surface of the terminating cover is spaced from the conductor receiving portions of the contacts to permit insertion and alignment of a cable for termination, the cross bar is positioned between and engaging said at least two latching protrusions, said terminating cover being movable from the first position toward the cable terminating face to terminate a cable, the cable terminating cover securing the cable in a terminated position at the second latched position, with said cross bar engaging one of said at least two spaced latching protrusions.

* * * * *